United States Patent [19]

Zeyra

[11] 3,994,324

[45] Nov. 30, 1976

[54] MEANS AND TECHNIQUES USEFUL IN INFLATING TOY BALLOONS

[75] Inventor: Avraham Zeyra, Los Angeles, Calif.

[73] Assignee: Creative Balloons, Inc., Santa Monica, Calif.

[22] Filed: Mar. 31, 1975

[21] Appl. No.: 563,500

[52] U.S. Cl. ..... 141/349; 222/70

[51] Int. Cl.[2] ..... B65B 3/36

[58] Field of Search ..... 46/90; 137/223; 141/4, 141/10, 99, 114, 197, 313, 317, 348, 349, 383; 222/3, 70; 251/20, 22

[56] References Cited

UNITED STATES PATENTS

| | | | |
|---|---|---|---|
| 3,191,801 | 6/1965 | Standish | 141/317 X |
| 3,368,742 | 2/1968 | Plante et al. | 222/70 |
| 3,536,110 | 10/1970 | West | 141/313 X |

*Primary Examiner*—Richard E. Aegerter
*Assistant Examiner*—Frederick R. Schmidt
*Attorney, Agent, or Firm*—Lyon & Lyon

[57] ABSTRACT

A toy balloon is automatically filled with helium gas using a system responsive to gas pressure. A novel check valve in the neck of the balloon is automatically opened upon insertion of a filling nozzle. The flow of gas to the nozzle from a constant pressure source is initiated by operation of a pushbutton which opens a valve which is resettable as a result of subsequent pressure build-up in the system. Opening of this valve results in opening a pilot valve through which gas flows to the balloon. Opening of the pushbutton operated valve also applies pressure to an expansible chamber of a timer valve through conduit means and when the pressure in such conduit means and in said expansible chamber become sufficiently high after a predetermined time (established to some degree by conditions in the nozzle and check valve) the timer valve is operated to apply gas pressure to an expansible chamber of the pushbutton valve to return it to its closed position thereby interrupting all flow to the balloon. An auxiliary manually operated valve is incorporated in the system to control the flow of gas to a balloon without the necessity of initiating the automatic cycle described above.

2 Claims, 5 Drawing Figures

B
9
10
14
11
15
5
10H
17
21C
21
21A
21B
25
SHUT OFF VALVE
23
MANIFOLD
PUSH BUTTON VALVE
30
28
32A
32B
32D
32G
32E
26
32F
32
32C
31
46
36
TIMER
33
38
33D
33A
33C
27
24
40
37
41
20
20A
50
PILOT VALVE
18
20C
20B

MEANS AND TECHNIQUES USEFUL IN INFLATING TOY BALLOONS

The present invention relates to improved means and techniques useful in inflating toy balloons.

An object of the present invention is to provide an improved toy balloon inflating system.

Another object of the present invention is to provide an improved filling valve for a toy balloon, such valve being particularly useful in the improved inflating system mentioned above.

While mention is made herein of toy balloons, it will be appreciated that the invention in its broader aspects is applicable also to other inflatable articles.

A specific object of the present invention is to provide an improved balloon inflating system which is responsive in its operation to pressure derived from the gas filling source and functions such that the necessity of auxiliary equipment, e.g. batteries is obviated.

Another specific object of the present invention is to provide an improved check valve insertable in the neck of the balloon and functioning to permit the flow of pressurized gas only into the balloon and requiring a manipulation to permit the exhaustion of the pressurized gas from the balloon.

Another specific object of the present invention is to provide an improved check valve insertable in the neck of the balloon with such valve functioning in a novel manner with respect to an insertable element of the filling apparatus. Another specific object of the present invention is to provide an improved check valve of this character which is relatively simple, inexpensive to manufacture, and yet is capable of providing good sealing at those low pressure differentials which prevail between the inside and outside of the toy balloon.

The features of the present invention which are believed to be novel are set forth with particularity in the appended claims. This invention itself, both as to its organization and manner of operation, together with further objects and advantages thereof, may be best understood by reference to the following description taken in connection with the accompanying drawings in which:

Figure 5:
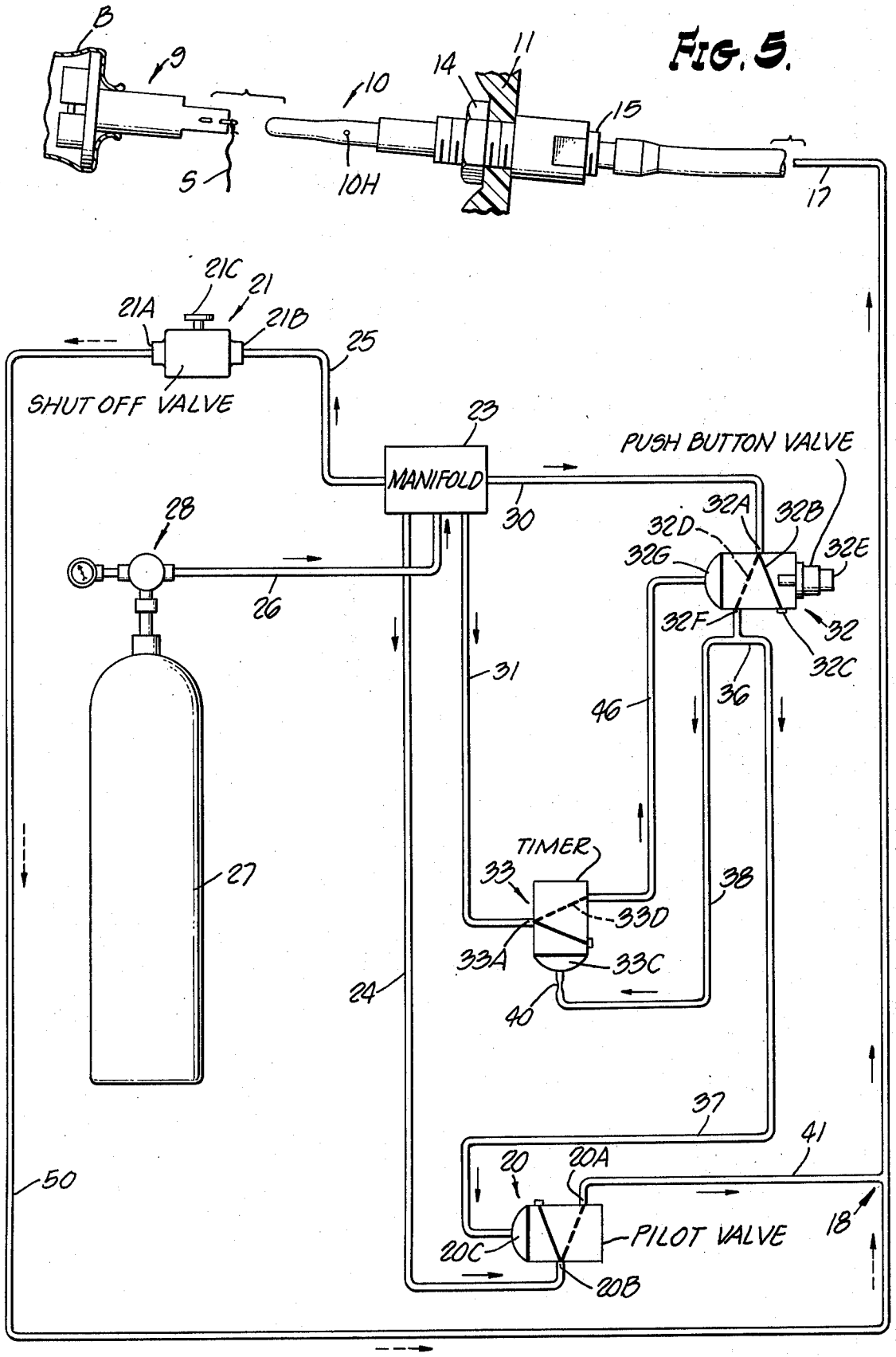
FIG. 5 is a toy balloon inflating system embodying features of the present invention which incorporate the valve and its actuating element which are illustrated in the previous FIGS. 1–4.

Referring to the inflating system shown in FIG. 5, it includes the check valve 9 which is normally self retained in the neck portion of a toy balloon B inflated by the apparatus shown in FIG. 5. The inflating nozzle 10 stationarily mounted on support member 11 is insertable in the valve 9 to actuate it to its valve open condition illustrated in FIG. 2. The nozzle 10 as shown in FIG. 2, is in general, a circular tubular metal element 10A which has a nose portion 10B, three shouldered portions 10C, 10D, and 10E and a hollow internally threaded portion 10F which is in comunication with the blind bore 10G, such bore 10G being in communication with a plurality of radial apertured portions 10H.

Figure 1:
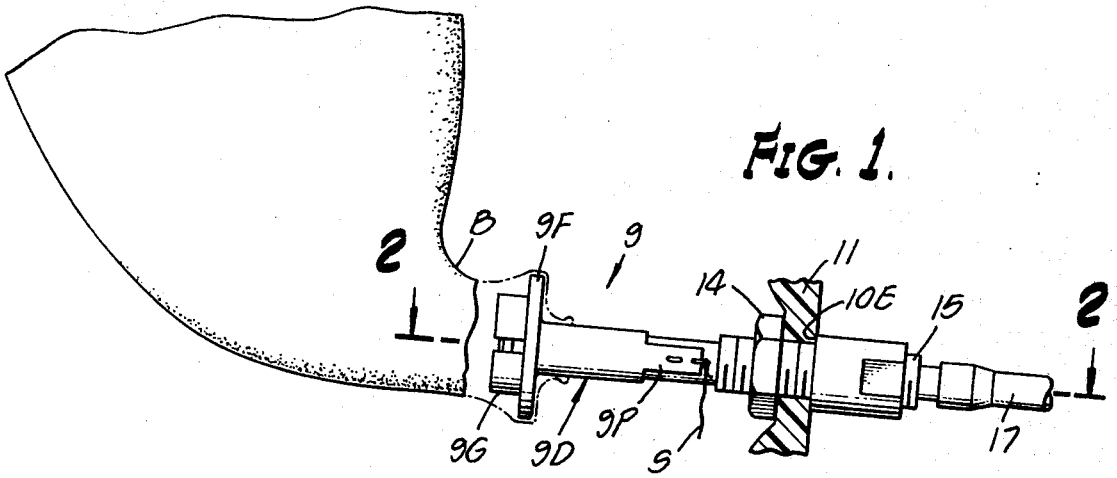
FIG. 1 illustrates a toy balloon in the process of being inflated.
Figure 2:
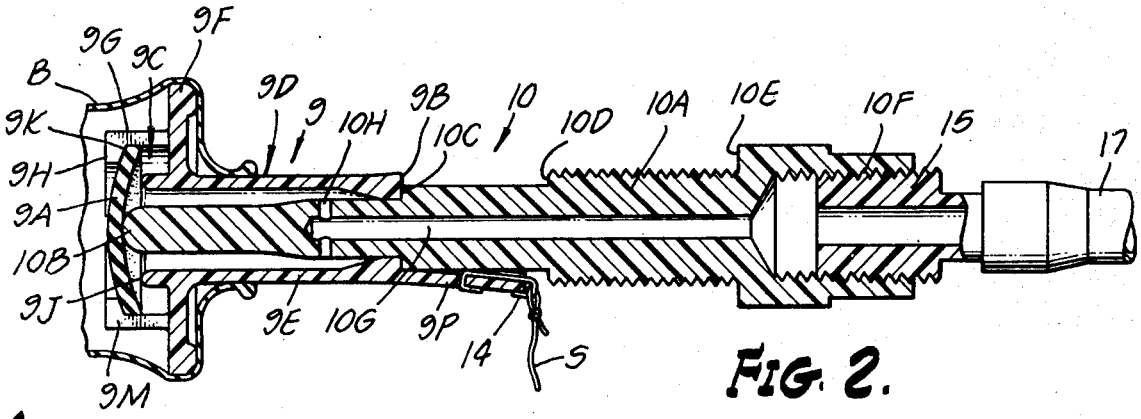
FIG. 2 is a sectional view taken substantially on the lines 2—2 in FIG. 1.
Figure 3:
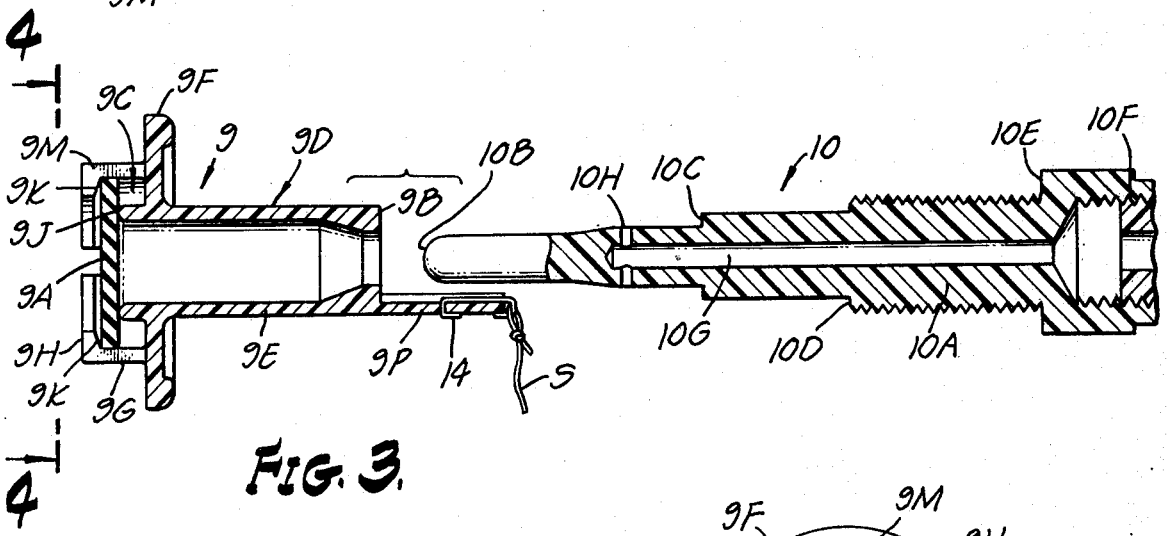
FIG. 3 is a view similar to FIG. 2 but with the valve actuating and filling element in its retracted position.

Once inserted as shown in FIG. 2, the nose portion 10B engages and deflects the circular or disc shaped resilient valve member 9A, which may be of rubber or like material, from its normally closed valve condition shown in FIG. 3 to its open filling position shown in FIG. 2. In such case, inward movement of the nozzle 10 in the valve element 9 is limited by engagement of the nozzle shouldered portion 10C with an end portion 9B of the valve 9 as shown in FIG. 2.

This resilient disc element 9A is initially in the manufacturing process inserted into and self retained in a cage portion 9C defined by integral portions of a plastic housing member 9D.

Figure 4:
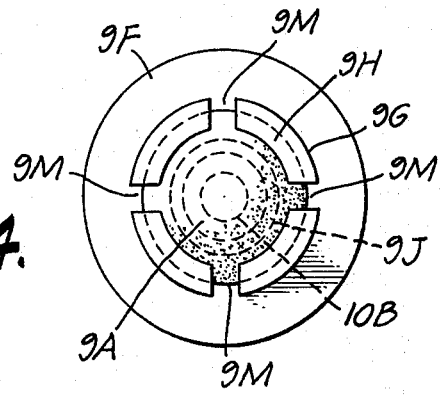
FIG. 4 is a view taken substantially as indicated by the lines 4—4 in FIG. 3.

It will be seen that the housing member 9D is formed with a relatively long tubular portion 9E of relatively small diameter from an intermediate portion of which the flange 9F extends. The flange 9F as illustrated in FIG. 2 sealingly engages the inner surface of the neck portion of balloon B. Integrally formed with the flange portion 9F is a modified tubular portion 9G of relatively large diameter, such tubular portion 9G being formed at its end with an inwardly extending flange portion 9H. As illustrated, such flange portion 9H is spaced both axially and radially, from the inner end 9J of the tubular portion 9D and is formed with an inner annular tapered surface 9K to provide a retention means for the disc 9A and also to provide a conforming stop for such valve disc 9A in its deformed condition shown in FIG. 2. Also, as illustrated in FIG. 4, such flange portion 9H is provided with four slit portions 9M that serve as openings through which the gas may flow when the valve disc 9A is deformed to its open condition shown in FIG. 2.

Normally, the valve disc 9A, in its condition shown in FIG. 3, has a portion thereof engaging the end 9J, such end 9J thus serving as a valve seat that sealingly engages the resilient disc 9A thereby normally preventing reverse flow of gas from a balloon B to the atmosphere, once the balloon is filled with helium or other gas. However, once filled, gas may be released from the balloon if desired, by inserting an element (not shown) into the valve 9 with sufficient force to produce a deflection of the rubber disc 9A valve in which case gas may then exit through the four slit portions 9M, past the valve seat 9J, and through the tubular portion 9D.

It is noted that the tubular portion 9D is sufficiently extended to provide an extended portion 9P for securing one end of a flexible string S using for example, a metal staple 14 secured to such end portion 9P and providing an eyelet for one end of the string S. Such string of long length which may be stored by initially winding it around the extension 9P, is of course, useful to control the balloon when it is inflated with a gas lighter than air as for example, helium.

It will be appreciated from the foregoing description that when the nozzle 10 is inserted as shown in FIG. 2, and there is pressure in the channel or bore 10G, a balloon B self secured on the flange portion 9F will be inflated.

The description which follows, describes apparatus capable of supplying such gas under pressure for a finite controlled time such that balloons of different nominal sizes, may be properly inflated to achieve such nominal sizes. For these purposes, the nozzle 10 secured by nut 14 to support 11, is threaded on the externally threaded portion of a hose fitting 15 on hose 17. Hose 17, as illustrated, is connected to a Tee fitting 18, so as to receive gas under pressure from either the outlet port 20A of a pilot valve 20 or the outlet port 21A of a manual shut off valve 21. The inlet port 20B of pilot valve 20 is, as well as the inlet port 21B of shut off valve 21, in communication with a manifold 23 via conduits 24 and 25 respectively. Such manifold 23 is supplied with gas, such as helium under pressure, from a conventional gas cylinder 27 through a conventional pressure regulator valve 28 which functions to maintain the gas flowing from valve 28 to the manifold 23 via conduit 26 under substantially constant pressure. The manifold 23 which may be thus referred to as a constant gas pressure source, has two other conduits 30 and 31 extending therefrom in communication respectively with the inlet ports 32A, 33A of a pushbutton valve 32 and a timer valve 33 respectively.

The pushbutton valve 32 is normally closed as indicated by the solid line 32B which extends from the inlet port 32A to a closed port 32C, but such valve 32 may be actuated to its open position illustrated by the dotted line 32D by manual actuation of the pushbutton 32E, in which case the inlet and outlet ports 32A, 32F of the valves 32 are in communication to thereby pressurize the expansible chambers 20C and 33C of the pilot valve 20 and timer valve 33 respectively. The outlet port 32F of valve 32 is in communication with the aforementioned chambers 20C and 33C through a Tee connection 36 and corresponding conduits 37, 38.

In operation of the system shown in FIG. 5, the valves 21 and 32 are normally closed in which case gas is prevented from escaping through the nozzle 10. To insitute a cycle of operations, the push-button 32E of valve 32 is depressed, in which case gas under pressure is supplied from gas cylinder 27 and conduit 26 and manifold 23 and conduit 30 and valve 32 and Tee connection 36 and through the conduits 37 and 38 to the corresponding chambers 20C, 33C of the pilot valve 20 and timer valve 33. It will be noted that the conduit 38 leading to the chamber 33C of the timer valve 33 is illustrated as having a restricted opening 40. Such restricted opening 40 is representative of the condition and functioning of timer valve 33 which operates and functions with a time delay required for the gas in its chamber 33C to become sufficiently large to actuate the timer valve 33 from its normally closed condition shown in FIG. 5 to its open position illustrated by the dotted line 33D. It will thus be appreciated that the pilot valve 20 is operated before the timer valve 33 as a result of a relatively quick buildup in pressure in the expansible chamber 20C. Thus, in a relatively short time, the pilot valve 20 is opened in which case gas is free to flow from the manifold 30 and from the inlet port 20B to the outlet port 20A via connection 24 and to the outlet conduits 41 and 17 thereby causing a flow of gas through the nozzle bore 10G (FIG. 2) and out through the apertured portions 9M (FIG. 4), and into a balloon. This gas flow into the balloon remains uninterrupted until a sufficient time has elapsed as required for operation of the timer valve 33 from its normally closed condition shown in FIG. 5 to its open position illustrated by the dotted line 33D. When the timer valve 33 is eventually open, gas under pressure is supplied from the manifold 23 via conduit 31 and valve 33 and conduit 46 to the expansible chamber 32G of the push-button valve 32 and when the pressure in such chamber 32G is sufficiently large, the push-button valve 32 is actuated back to its normal closed condition illustrated by the full line 32B.

It will be appreciated from the foregoing, that there is some interdependency between filling time and nominal size of the balloon, in that when a larger size balloon is being inflated, a larger time, depending upon the size of restricted orifice 40, is required. For that reason, the size of the opening in the restricted orifice 40 is adjustable so that such size is relatively small for inflating large balloons and relatively large for small balloons.

Instead of operating the push-button valve 32 a balloon may be filled by manual operation of the push-button 21C of the normally closed shut off valve 21 in which case there is a flow of gas under pressure from the manifold 23 through the valve 21 and conduits 50 and 17 to the nozzle 10. The provision of this shut off valve 21 is particularly useful in refilling of a balloon with helium to supply amounts which may have leaked through the latex of the balloon during, for example, an overnight inflated condition.

While the particular embodiments of the present invention have been shown and described, it will be obvious to those skilled in the art that changes and modifications may be made without departing from the invention in its broader aspects and, therefore, the aim in the appended claims is to cover all changes and modifications as fall within the true spirit and scope of this invention.

I claim:

1. In a system for inflating an inflatable article, said system including a check valve in an opening in said article allowing gas flow into said article but preventing reverse flow from said article; nozzle means cooperatively associated with said check valve for opening the same and for delivering gas under pressure through said check valve to said article; a source of gas pressure; a manifold in communication with said source; means maintaining the gas pressure in said manifold substantially constant; a normally closed resettable manually operable valve having an inlet port and a outlet port and having manually operable means for opening said resettable valve and thereby intercommunicating said ports (to thereby open said resettable valve); means communicating said manifold with said inlet port; first pressure responsive means for resetting said valve to its normally closed position; a normally closed pilot valve having an inlet port and an outlet port; means communicating said manifold with said pilot valve inlet port; the last mentioned outlet port being in communication with said nozzle means; second pressure responsive means for opening said pilot valve and thereby intercommunicating said inlet and outlet ports of said pilot valve (to therby open said pilot valve); the outlet port of said resettable valve being in communication with said second pressure responsive means; a normally closed timer valve having an inlet port in communication with said manifold and an outlet port in communiction with said first pressure responsive means; third pressure responsive means for opening said timer valve and thereby intercommunicating said inlet and outlet ports of said timer valve (to thereby open said timer valve); conduit means; said third pressure responsive means being in communication with said outlet port of said resettable valve through said conduit means; said conduit means incorporating means for delaying, for a time interval, pressure build-up in said third pressure responsive means to thereby delay opening of said timer valve after said resettable valve is opened; said third pressure responsive means, when operated by a build up in gas pressure applied thereto through said conduit means and said delaying means, being effective to open said timer valve to thereby intercommunicate said manifold with said first pressure responsive means and cause said resettable valve to close; a second manually operable valve for intercommunicating said manifold with said nozzle means and the outlet of said pilot valve such that opening or either said pilot valve or said second manually operable valve results in gas pressure being supplied to said nozzle means; said check valve having a valve seat; said check valve incorporating a valve element comprising a resilient disc; means for sealingly engaging said disc with (which normally, due to resiliency of said disc, sealingly engages) said valve seat to close said check valve; said nozzle means being insertable in said check valve to engage and move the central portion of said valve disc to move it away from its seat.

2. In a system for inflating an inflatable article, said system including a check valve in an opening in said article allowing gas flow into said article but preventing reverse flow from said article; nozzle means cooperatively associated with said check valve for opening the same and for delivering gas under pressure through said check valve to said article; a source of gas pressure; first normally closed and manually operable valve means having an inlet port and an outlet port, said inlet port being in communication with said source; manual means for opening said first valve means thereby intercommunicating said inlet and outlet ports; resettable means for restoring said first valve means to its closed position wherein said inlet and outlet ports are no longer in communication; second normally closed valve means having an inlet port in communication with said source and an outlet port in communication with said nozzle means; third normally closed timer valve means having an inlet port in communication with said source and an outlet port in communication with said resettable means; means responsive to pressure at the outlet port of said first valve means for operating said second valve means from its normally closed position to an open position wherein said source is then in communication with (siad) said nozzle means; said third valve means incorporating means responsive to pressure at said outlet port of said first valve means for operating said third valve means from a normally closed position to a normally open position where said third valve means then communicates said source to said resettable means to effect resetting of said first valve means to its closed position; conduit means intercommunicating the outlet port of said first valve means with said operating means for said second valve means; and means in said conduit means for delaying for a time interval the build up in gas pressure supplied from said first valve outlet port to said operating means for said third valve means to thereby delay opening of said timer valve after said first valve means is opened.

* * * * *

UNITED STATES PATENT OFFICE
CERTIFICATE OF CORRECTION

Patent No. 3,994,324 Dated November 30, 1976

Inventor(s) Avraham Zeyra

It is certified that error appears in the above-identified patent and that said Letters Patent are hereby corrected as shown below:

In Claim 1, line 14, cancel -(to thereby open said resettable valve)-.

In Claim 1, line 24, cancel -(to therby open said pilot valve)-.

In Claim 1, line 32 and 33, cancel -(to thereby open said timer valve)-.

In Claim 1, line 53 and 54, cancel -(which normally, due to resiliency of said disc, sealingly engages)-.

In Claim 2, line 25, cancel -(siad)-.

Signed and Sealed this

Twenty-second Day of March 1977

[SEAL]

*Attest:*

RUTH C. MASON
*Attesting Officer*

C. MARSHALL DANN
*Commissioner of Patents and Trademarks*